United States Patent [19]

Aftalion

[11] Patent Number: 4,613,470

[45] Date of Patent: Sep. 23, 1986

[54] IN LINE PROCESS FOR SEQUENTIALLY FORMING AND SHAPING A FILAMENT

[76] Inventor: Sebastian Aftalion, 122 Telford Road, East Kilbride, Glasgow, Scotland, G75 OBX

[21] Appl. No.: 617,622

[22] Filed: Jun. 6, 1984

[30] Foreign Application Priority Data

Jun. 6, 1983 [GB] United Kingdom ..... 8315426

[51] Int. Cl.[4] ..... B29C 35/10; D01D 5/20

[52] U.S. Cl. ..... 264/22; 264/25; 264/26; 264/167; 264/210.4; 264/210.8; 264/289.3; 264/290.5; 264/290.7; 264/288.8

[58] Field of Search ..... 264/22, 167, 25, 26, 264/210.8, 288.8, 290.5, 289.3, 290.7, 210.4; 204/159.14; 8/DIG. 12; 65/2, 268, 102

[56] References Cited

U.S. PATENT DOCUMENTS

| | | | |
|---|---|---|---|
| 3,069,726 | 12/1962 | Adams . | |
| 3,323,165 | 6/1967 | Mottern et al. . | |
| 3,912,478 | 10/1975 | Presby . | |
| 4,038,062 | 7/1977 | Presby . | |
| 4,129,433 | 12/1978 | Jaeger et al. . | |
| 4,138,298 | 2/1979 | Bobeth et al. | 8/DIG. 12 |
| 4,190,623 | 2/1980 | Bobeth et al. | 8/DIG. 12 |
| 4,247,496 | 1/1981 | Kawakami et al. | 264/22 |
| 4,430,277 | 2/1984 | Lin | 264/22 |

FOREIGN PATENT DOCUMENTS

| | | |
|---|---|---|
| 1529970 | 6/1967 | France . |
| 1116618 | 6/1968 | United Kingdom . |

*Primary Examiner*—Donald Czaja
*Assistant Examiner*—Hubert C. Lorin
*Attorney, Agent, or Firm*—Bacon & Thomas

[57] ABSTRACT

A fibre (1), which may be an artificial polymeric, glass or glass-fibre fibre, is treated by exposing it to an energy flux (2) so that the fibre absorbs energy differentially along its length, and the cross-section of the fibre is altered in response to the varying amounts of energy absorbed along the length of the fibre, to yield a fibre which has intermittent zones of relatively reduced cross-section. Preferably the fibre is drawn past an energy beam which is pulsed or oscillated across the fibre path. The fibre may be exposed while it is being formed by drawing it under tension from a spinneret nozzle, and is further stretched after exposure to the beam to form intermittent necks (3) in the fibre. The novel fibres may be used in textile applications or as reinforcing elements in composite materials.

8 Claims, 4 Drawing Figures

IN LINE PROCESS FOR SEQUENTIALLY FORMING AND SHAPING A FILAMENT

This invention relates to novel shaped fibres, a process for their production by treating fibres to shape them, and to the use of the shaped fibres in textile-related fields and in composite materials.

Technology has utilised fibre materials for a very long time. Originally the fibres were of natural origin, but have now partially been replaced by man-made fibres. The application of fibres can be roughly divided into direct utilisation such as monofilament, yarn, textiles, knittings and the like and on the other hand as a component of composite materials, wherein the matrix materials can for example be inorganic cements, castable polymers, thermoplastics, elastomers (e.g. tires) or metals. The technological properties of fibres or fibre-like materials required for each above mentioned purpose are mostly well defined, but are always subject to improvements, especially in man-made fibres.

Textile fibres have been known for example to be adapted for special utilisation by processes such as yarn texturing. This is accomplished by different methods, after the fibre operation. For example, stretch yarn can be obtained by twisting, by the stuffing box method or by non-isothermal drawing over knife edges, resulting in proprietary products such as those stretch yarn products marketed under the trademarks HELANCA, BAN-LON, FLUFLON, AGILON and others.

Another domain of property enhancement can in general be described as surface treatment of fibres. Dyeing and moth proofing for textiles are self explanatory. Yet another type of surface treatment is required when the fibres form part of a composite material as reinforcing agent. The surface treatment in this case is a major factor regarding fibre utilisation efficiency, e.g. in respect of the achievement of optimal mechanical properties, especially regarding good long term performance. Mechanical properties subjected to strict quality assurance rules are very often disappointing, compared with results obtained under laboratory conditions. For example glass fibre reinforced plastics, even with an adhesion enhancing surface treatment of the fibres, lose their tensile strength to an appreciable degree after several weeks exposure to water. Short fibre composites, for example thermoplastic polyolefin based types, are liable to suffer fibre pull-out when stressed.

The object of this invention is to enhance the applicability of man-made or modified natural fibres, including fibre-like products, by a novel approach in which their geometry or shape is modified.

According to one aspect of the present invention there is provided an artificial polymeric, glass or glass-like fibre having intermittent zones of relatively reduced cross-section along its length.

The invention does not encompass natural fibres, such as hair, which have irregular cross-sections, but does extend to artificially extruded fibres of naturally originating polymers, such as fibres of regenerated cellulose spun from a viscose solution.

In general, suitable polymers contain carbon in the polymer chain, for example in carbon-carbon linkages or carbon-silicon linkages.

According to another aspect of the invention there is provided a process for treating a fibre, which comprises exposing the fibre to an energy flux so that the fibre absorbs energy differentially along its length, and differentially altering the cross-section of the fibre in response to the varying amounts of energy absorbed along the length of the fibre.

The energy flux may be provided by any suitable beam or field. A beam of energetic particles may for example comprise electrons, ions or photons, a photon beam corresponding to an electromagnetic wave beam (e.g. an infra red, visible light, ultraviolet or soft X-ray beam). A short range electromagnetic field can for example be achieved in a capacitor gap; thus a fibre to be treated can be passed between the plates of a pulsed capacitor. In general, intermittent treatment of the fibre with a beam is considered particularly convenient, and the further description herein will refer principally to beams for this reason.

Differential absorption of energy by the fibre can be achieved by varying the intensity of the energy flux falling on the fibre, by varying the duration for which the treated portion of the fibre is exposed to the energy flux, or by varying the absorptiveness of the fibre along its length (for example by incorporating additives which interact with the beam). Generally, it is convenient to draw the fibre past the energy source and to modulate the intensity of the beam used to treat the fibre of oscillate the beam along or across the fibre path.

Treatment is normally carried out when the fibre is under some degree of tension, at least sufficient to keep the fibre taut, and in a preferred aspect of the invention sufficient to stretch the fibre after it has been treated. It is particularly suitable in many cases to treat the fibres, in line, during the fibre forming process, which may for example be melt spinning, or dry or wet solution spinning. The fibre is preferably exposed to the beam during solidification after spinning, but may optionally be exposed during a later stretching process, and possibly even after that. Melt-spun fibres, which may for example be of glass, nylon or polyester, may stretch during solidification to give a reduction in cross-section of up to 100 or even 10,000 times, equivalent to a ten- or one-hundred-fold diameter reduction in round fibres; and textile fibres, for example organic polymers, may also be cold-stretched by up to fifteen times, e.g. two to four times, after solidification.

The effect of the energy flux on the fibre may be to alter temperature-dependent physical properties of the fibre, such as viscosity and surface tension, which can be exploited to create differential cross-sectional changes in the fibre during appropriate subsequent treatment, such as by increased stretching. Alternatively, the effect may be to bring about chemical changes. Examples of chemical changes include cross-linking initiated by ultraviolet light, to decrease the extent of subsequent stretching in the treated zones, and gas-forming reactions which lead to local foaming in the fibre. Other effects may also occur and be utilised in the invention.

The novel fibres according to the invention are most preferably produced by treating fibres of uniform cross-section in accordance with the process of the invention.

It is envisaged that fibres in accordance with the invention may be of unlimited length. The fibres are typically formed as continuous filaments and may optionally be subsequently cut or chopped into shorter fibre lengths according to requirements as dictated by their end use.

The fibres need not be of solid circular cross-section. They may be ribbon-like, e.g. with a breadth up to four times the height, triangular, hollow or in any other form in which fibres are produced. For convenience, mechanical deformation methods may be preferred to the process provided by this invention for shaping fibres above about 5 mm diameter, and 1 or 2 mm diameter (or the equivalent cross-sectional area) may be a more suitable maximum size.

The zones of greater and lesser cross-section may be referred to as humps and necks respectively, for ease of reference. Either may correspond to the treated zones, according to whether the treated zones acquire relatively greater or lesser cross-sections. More commonly, when the fibre is intermittently exposed to a beam of constant intensity to enhance stretching, the treated zones become uniform necks. In glass fibre, a preferred frequency for the necks is about 3 to 10 per millimeter length of fibre. In textile fibres, a preferred frequency is from about one-half to twenty times the diameter of the fibre. More broadly, about 1 to 50 necks per millimeter are in general preferred, with 10 to 30 necks per millimeter being preferred for textile fibres in particular.

The invention will be further described with reference to the accompanying diagrammatic drawings, in which.

Figure 1:
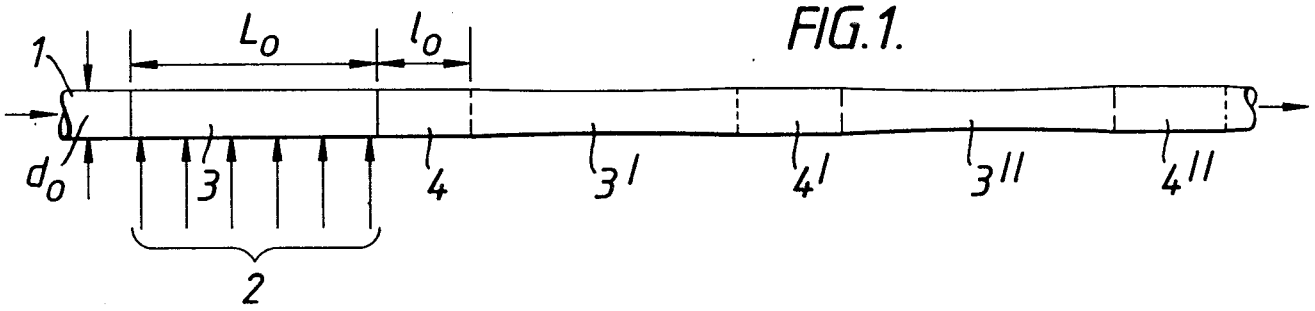
FIG. 1 represents a fibre being stretched under tension past an intermittent energy beam.
Figure 2:
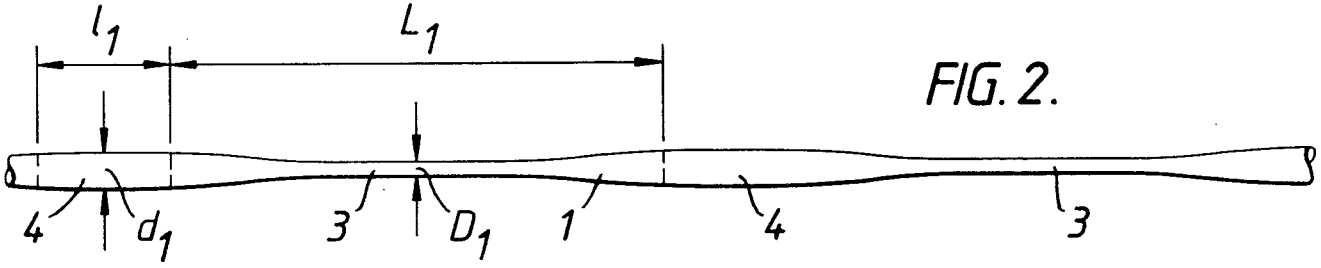
FIG. 2 represents the same fibre after further stretching.

FIG. 1 shows a fibre 1 of initial diameter $d_o$ being exposed to an energy beam 2, so that energy is absorbed by the fibre in a zone 3 of length $L_o$. Since the beam is intermittent, the exposure is repetitive along the moving fibre. Previously exposed zones 3' and 3'' are shown separated by unexposed lengths of fibre 4, 4' and 4'' of initial length $l_o$. FIG. 2 shows the final fibre shape after further stretching, whereby the diameter in the unexposed zones 4 has been reduced to $d_1$, the diameter in the exposed zones 3 has been further reduced to $D_1$, the length of the exposed zones 3 has been increased to $L_1$ and the length of the unexposed zones 4 has been increased to $l_1$. The length increase in the exposed zones is proportionately greater than in the unexposed zones, due for example to a local temperature rise, and the unexposed zones thereby form humps and the exposed zones form necks in the treated fibre. Preferably, the ratio $l_1$:$L_1$ is between 0 and 1, and more preferably from 0.1 to 0.2. In the case where increased temperature governs the necking behaviour of the fibre, the length $L_1$ of the exposed zone 3 will be dependent not only on the length $L_o$ directly exposed to the beam 2 but also on such factors as the temperature diffusivity coefficient of the fibre material ($m^2$/sec) and the local heat transfer coefficient between fibre and environment. In the latter context, the necked and humped portions of the fibre may not be coaxial if asymmetric cooling conditions prevail, such as in the presence of air currents.

The necks in the fibre may be equally spaced or may be programmed to occur according to a more complex pattern. The pattern is in general likely to be periodically repeated. The necks may be equally spaced within groups, with larger spacings between groups; for example, 10 mm fibre lengths comprisng closely spaced necks may be separated by 5 mm lengths of uniform fibre.

Shaped fibres for use in composite materials may suitably exhibit hump: neck diameter ratios ($D_1$:$d_1$) of about 0.9 to 0.7, corresponding to cross-sectional area ratios of about 0.8 to 0.5. For textiles, the greater reductions are more preferred, with cross-section ratios of 0.7 to 0.5, especially 0.6 to 0.5. Excessive reduction of cross-section in the exposed zones can reduce the strength of the fibre unacceptably.

In carrying out the process of the invention, a bundle of fibres, especially from a multiple orifice spinnneret, may suitably be treated at one time. It is naturally preferred that the fibres of the bundle do not overlap with respect to the incident beam.

The exposed parts of the fibres absorb locally, in an intermittent mode, part of the beam's energy, which causes changes in one or several of the fibre properties governing the fibre formation in the spinning process.

As an example, in the case of melt-spinning, energy absorption will locally increase the temperature of the forming fibre, which results in a decrease of its viscosity and surface tension. As a result of this, cross-section changes, i.e. repetitive necking of the fibre, will occur.

Another example is dry spinning from a polymer solution. Here in addition to the above described effects there will be a local increase of the solvent vapor pressure. The result will be again a repetitive necking of the fibres formed.

Additional effects of intermittent local energy absorption can be promoted either on fibres made from unmodified starting materials or on the fibre materials with deliberate admixtures of selected agents. As an example, light absorbing components can be added to enhance the energy absorption. Other additives can promote local changes by photochemical reactions, can create local foaming of the fibre, or can act as agents to change the local viscosity.

A stretching process subsequent to the fibre spinning operation will obviously change the geometry of the necked fibres made according to the invention, but in all cases the variable cross-section pattern will be maintained. The same is valid if other consecutive treatments are involved, such as thermal and/or oxidation processes, which may be necessary to modify the original polymer substance, or may even change their chemical nature to a wider degree, such as to produce carbon fibres, silicon carbide fibres, and the like.

In any case it will be possible to tailor a variable cross-section pattern into the final fibre product to suit best the final use of the product.

The energy transfer from the beam to a fibre will be determined by three factors. The first factor is the energy flux of the beam given by its intensity (Watt/$cm^2$) and its cross-section ($cm^2$). The second factor is the residence time (sec) of the beam upon the fibre. The third factor is the relevant absorption coefficient of the fibre material for the given beam type. For a light beam the spectral absorption coefficient ($cm^{-1}$) would be relevant and for electron or ion beams the relevant attenuation coefficient. If the required effect of the beam: fibre interaction is a direct temperature increase in the irradiated fibre zone, the energy to be absorbed from the beam is determined by the temperature increase necessary to achieve a given viscosity change. When other types of interaction (for example enhanced evaporation or photochemical reactions) are involved the procedure will be the same—there should be sufficient energy absorption in the irradiated fibre zone to achieve the purpose.

Figure 3:
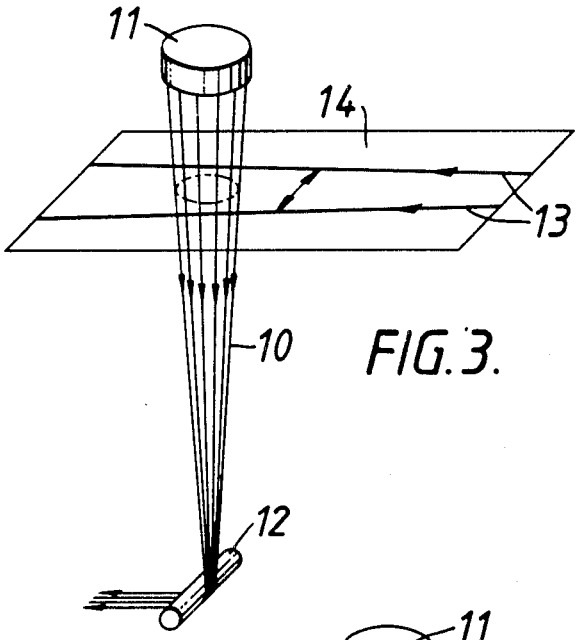
FIG. 3 illustrates the treatment of a bundle of fibres emerging from a spinneret by a scanning energy beam.
Figure 4:
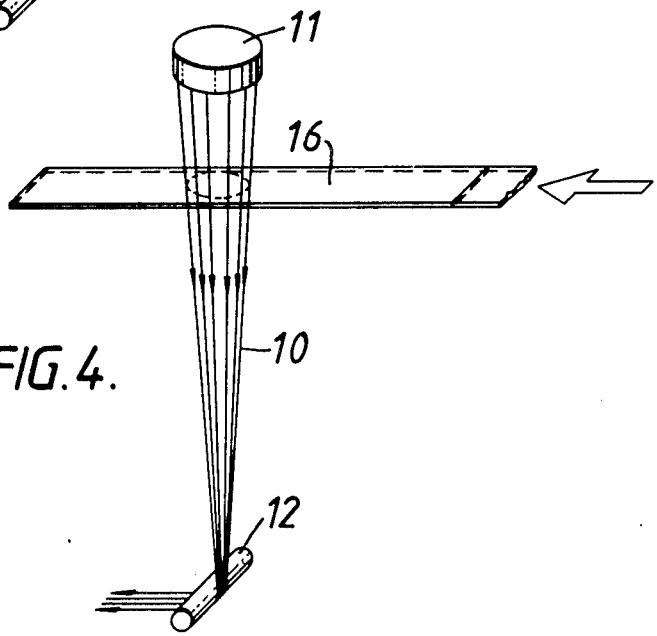
FIG. 4 illustrates an alternative treatment by a flat energy beam.

Since the result of the process of the invention is to create a recurrent cross-section change in the fibres subjected to the beam, the irradiation of the moving fibres must be varied and is preferably intermittent. This can be achieved in several ways. A bundle of fibres, moving at a given speed, may be considered. FIGS. 3 and 4 of the accompanying drawings illustrate schematically two embodiments of the process.

One way of achieving intermittent exposure of the fibres to the beam is shown in FIG. 3. A bundle of fibres 10 moves downwards from a spinneret 11. Before the fibres pass around a thread guide 12, a beam 13 of round cross-section is operated in a scanning mode in a plane 14 perpendicular to the direction of the fibre movement at a given, fixed position relative to the total set-up. This means that the beam will impinge consecutively upon each fibre of the bundle, exposing each fibre for a short, approximately equal time, and thus transferring the required energy to each fibre zone. The length of this zone will be in general about equal to the beam diameter, provided the fibre velocity is about an order of magnitude less than the scanning velcoity of the beam.

Another way to achieve intermittent exposure of the fibres to the beam is shown in FIG. 4, where the beam 16 has a flat cross-section, the bigger dimension being at least equal to the greatest breadth of the fibre bundle 10 and the smaller dimension of the flat beam corresponding to the length of the fibre zone which is to be exposed to the radiation. In this case the beam's intensity is varied by intermittently pulsing the beam, thus defining the exposure time of the fibres to the irradiating beam. Here again a well defined energy absorption for each fibre can be achieved.

Instead of using an intermittent flat beam, it is also possible to use a flat beam in a scanning mode—the flat beam is again perpendicular to the fibres, but instead of pulsing the beam's intensity the beam is reciprocated along the direction of fibre movement, with a velocity similar to the fibre velocity. In this way consecutive fibre zones will receive variable exposures to the beam, and there will be a modulation of absorbed energy equivalent to an intermittent exposure.

Still another way to achieve an intermittent exposure of the fibres to the beam is a modification of the first approach. Here instead of using one scanning beam, an array of several beams of similar size and intensity are aligned along the direction of fibre movement and spaced in that direction according to a desired pattern. All beams scan the fibre bundle in a direction across the direction of fibre movement at such a frequency that when they return from their maximal scanning height and fall on the bundle again they expose virgin, non-exposed fibres adjacent to the previously irradiated fibre zones.

A modification of this approach can also be used: the returning beam array can fall on the fibre again partially overlapping the previously exposed length of fibre, but exposing it between the formerly exposed zones.

As sources of electromagnetic (light) beams, the following are suitable.

Firstly, incandescent light sources such as electrically heated metal filaments, silicon carbide elements, super kanthal elements and the like. For some applications spectral filtering may be necessary.

Secondly, high intensity electrical gas discharges, for example mercury or noble gas (such as xenon) high pressure type lamps, which can be used in a steady state or modulated mode of operation.

Thirdly, in some cases laser radiation sources should be considered, including gas lasers such as the carbon dioxide laser ($CO_2$-laser), solid state lasers such as the neodymium-yttrium-aluminium-garnet laser (Nd:YAG laser) and others.

The choice of the light source will depend on the fibre raw material (polymers, polymer blends, glass, etc.), the spinning process involved and the type of variable cross-section pattern desired in the final fibre. When monochromatic light sources, or sources with more or less discrete wavelength emission characteristics, are to be assessed, the spectral absorption coefficient or coefficients of the material to be spun or subjected to modification are the criteria for the selection: a good matching increases absorption efficiency.

The configuration of the beam itself (round, single or multiple, flat, or the like) and the means for its movement can be achieved using classical optical means, such as lenses and mirrors, part of which will be used to create the necessary motion of the beam. This movement can be achieved by oscillating mirrors or lenses, driven electromagnetically (galvanometer type) or by magnetostrictive or piezoelectric motors. When using lasers the relevant pulsing techniques should also be considered.

The size of a round beam may be of the order of magnitude of several fibre diameters (say 10 to 100 micrometers) at the fibre target. Flat beams may have their narrow dimension similar to the diameter of the round beam; their greater dimension may be equal to or slightly greater than the fibre bundle width.

The frequency (scanning rate) of a round beam should be selected such that consecutive zones on the fibre exposed to the beam are separated by a suitable non-exposed length. This can be chosen to be about equal to several times bigger than the exposed part. The scanning rate is one of the parameters determining the variable cross-section pattern.

Another parameter codetermining the pattern is the beam's intensity, together with the spectral absorption coefficient of the material of the fibre, which depends on the fibre's composition (with or without absorption promoting additives).

Yet another parameter is the amplitude of the scanning beam, which relates to the velocity of the beam when crossing the fibre. This determines the exposure time of the fibre to the beam.

Adjusting the beam's energy (tuning) can be achieved either by direct variation of the primary sources of the beam or also, in the case of a beam scanning operation, by increasing the amplitude of the beam's scan (shortening of the exposure time).

For flat pulsed beams either the primary energy source power can be changed, or the pulse duration modified. The pulse repetition rate stays the same.

At the present time spinning processes work with fibre velocities at the take-up elements of about 10 to 50 meters per second. Considering fibre diameters of say 5 to 50 micrometers, the order of magnitude of the beam's power needed for an average cross-section will be about 10 to 500 Watt, depending on the properties of the spinnning raw material and on the spinning process used.

Fibres in accordance with the invention may be used as such, i.e. as monofilament line, or may be used in textile applications or as a reinforcing element in a composite material. Accordingly, the invention includes within its scope spun yarn comprising the shaped fibres;

cloth or fabric, for example woven, felted, knitted, needled or bonded, comprising the shaped fibres; and composite materials comprising the shaped fibres embedded in a solid matrix material.

Suitable applications for monofilament line include fishing lines and nets, where the properties of the shaped fibre include an increased resistance to slipping when knotted.

To illustrate the application of the invention to composite materials, a composite material made of an organic castable material (say polyester or epoxy type) with embedded long glass fibres, which were modified according to this invention, will show the advantage of the novel shaped fibres. Consider a test piece made from this composite with fibres in the direction of the applied stress imposed upon the sample. If the glass fibres were of the normal, surface treated cylindrical shape, above a given stress level, debonding would eventually occur, which can be identified by, say, increased water absorption of the specimen. In contrast to this, the glass fibre in accordance with the invention will behave differently. Since the fibres are of variable cross-section, with say about 5 to 10 rounded necks per millimeter length, each neck will act like a truncated conical wedge, locking the fibre into the organic matrix due to two factors. The first factor is purely geometric—a radial component of the axial pulling force is created due to the cone's angle (its deviation from the cylindrical shape). The second factor is the frictional force arising between the conical part of the necked glass fibre and the matrix, acting opposite to the axial pulling force. It is the same effect as in a bolt/screw combination where the threads have a final, non-zero friction factor—the torque applied to the bolt is balanced by the stress-build-up in the screw plus the friction momentum in the thread. In the case of a cylindrical glass fibre there is no radial pressure force generated on longitudinal stress, which would give rise to friction: on the contrary, due to diameter contraction of the fibre on elongation and a tendency to hole widening in the matrix material, a tensile stress is built up on the interface; once the bonding between glass and matrix is broken, local failure will occur.

Since the elasticity (Young's modulus) of glass is about 10 times bigger than for common organic castable materials, a pulling force on the fibre of the invention will be transmitted along its length, distributing the loading force to the large number of conical humps (necks) present on the fibre. Chemical-type adhesion between glass and matrix is replaced by mechanical forces, mainly frictional. As a result the limiting factor for the composite tensile strength can be pushed towards the tensile value corresponding to the sum of the tensile strengths of all the individual glass fibres. A simplified stress analysis calculation shows that about 10 to 30 humps (necks) of the fibre will be able to carry a load corresponding to the rupture stress of a 10 micrometer glass fibre (based on long time permissible stresses of about 10 $N/mm^2$ for the polymer and 100 $N/mm^2$ for the glass fibre).

The behaviour of the novel type of fibre obviously will be analogous in other matrices, e.g. all composites, where the Young's modulus of the fibre is greater than that of the matrix.

A positive effect due to the novel fibre of the invention is also apparent in composites where both components have similar Young's moduli, but where the matrix has poor tensile properties and long-term adhesion is problematic, such as silicate based or other hydraulic binding castables (e.g. Portland cement) with fibre reinforcement.

Another example of the application of the invention concerns the effect called "pilling"—the formation of fluffy little balls or pills appearing on the surface of woven textiles and knitwear. This product defect is caused by protruding fibres, especially short ones, which form pills when rubbed during utilisation of the product. The way the yarn is made and especially the fibre material and/or mixture, as well as fabric type, are major factors for the degree or absence of pilling. Increased yarn twist reduces the formation of pills. There is no generally agreed mechanism to explain or predict the appearance of this defect. It is however, established that very many of the man-made fibres (polyamides, polyesters and the like) create problems in finished products by pilling. It has been established that non-round cross-section fibres of the above materials are beneficial with respect to this defect.

Therefore it is reasonable to expect that fibres incorporating in their formation the novel shape, namely recurrent cross-section change along their length, will show improvements regarding pilling. A yarn made of the novel fibre will show a large increase in friction between the individual fibres in the yarn, due to the humps (necks) present. Slippage of an individual fibre out of the yarn will be blocked by the humps (necks) as if there were a series of knots in the fibre, rubbing against the knots of the fibre bundle of the remaining part of the yarn. The feel of an individual novel type of fibre, when pulled between two fingers, will not be smooth but slightly rough.

As an example of the production of a novel fibre according to the invention the modified melt spinning of glass fibres will be considered.

A fibre spinning set-up, making 10 micrometer diameter fibres at a rate of 10 meters per second, is provided with a scanning infrared beam system comprising an infrared source supplying an approximately parallel beam of about 10 millimeters diameter, which falls on a mirror vibrating with a frequency of about 30 kilohertz ($3\times10^4$ cycles per second). The so periodically deflected beam falls on a non-moving concave focussing mirror from which a now converging beam falls on the passing glass fibres in a scanning mode, across the direction of movement of the fibres. The diameter of the convergent light beam, when reaching the glass fibres, is reduced to around 50 micrometers (0.05 mm) by the focussing mirror. The fibres will be illuminated twice by the beam during one period of the beam's oscillation, thus forming 60,000 hot spots per second. At a fibre speed of 10 meters per second, this corresponds to a repetition distance of 167 micrometers (0.167 mm) on the finished fibre. The beam will impinge on the fibres where the diameter of the fibres is say 10% bigger than their final diameter. The parts of the fibres exposed to the beam, if heated up by about 10° Centigrade, would reduce their viscosity by a factor of about two. This would increase their strain rate locally by about a similar amount, thus causing necking. Since the cooling rate of each fibre at the necked position is greater, due to the smaller fibre diameter, a necked shape will be frozen into the final fibre. Heating up the irradiated spots by 10° Centigrade under the described conditions (assuming a fibre bundle diameter of about 20 mm) would require an infrared beam power of 300 Watt, assuming 10 percent absorption of the beam's power by the glass.

In practice less than 10° Centigrade heating up will be required to achieve appreciable necking.

I claim:

1. An in line process for sequentially forming and shaping a filament, comprising spinnning the filament in a fluid state at a uniform rate from a nozzle, drawing out the spun filament and allowing the drawn filament to solidify; including the steps of:

drawing the filament during its solidification process past a source of rapidly fluctuating energy flux and thereby causing the filament to absorb energy in varying amounts along the length of the filament, and stretching the filament after the energy absorption step whereby to reduce its cross-section and form intermittent zones of relatively greater and lesser cross-section along its length, the zones of different cross-section corresponding to regions of the filament that were exposed to different amounts of energy;

the fluctuations in the energy flux and the stretching of the exposed filament being selected to produce cross-sectional area ratios between the zones of relatively greater and lesser cross-section of at least 1:0.8 and a frequency of cross-sectional change of at least one per millimeter over at least part of the length of the solidified stretched filament.

2. A process according to claim 1 wherein the source of rapidly fluctuating energy flux is an energy beam of modulated intensity directed at the filament.

3. A process according to claim 1 wherein the source of rapidly fluctuating energy flux is an energy beam which is oscillated along or across the path of the solidifying filament.

4. A process according to claim 1 wherein the filament is one of a bundle of filaments spun simultaneously from a multiple orifice spinneret, and all filaments in the bundle are similarly exposed to the energy flux and altered in cross-section.

5. A process according to claim 1 wherein the filament is exposed to a periodically repeated energy flux pattern along its length to produce a corresponding periodically repeated pattern of cross-sectional changes in the solidified stretch filament.

6. A process according to claim 1 wherein the fluctuations in the energy flux and the stretching of the exposed filament are selected to produce cross-sectional area ratios between the zones of relatively greater and lesser cross-section of from 1:0.8 to 1:0.5.

7. A process according to claim 1 wherein the fluctuations in the energy flux and the stretching of the exposed filament are selected to produce from 1 to 50 zones of relatively lesser cross-section per millimeter length of the solidified stretched filament.

8. A process according to claim 1 wherein the fluctuations in the energy flux and the stretching of the exposed filament are selected to produce one zone of relatively lesser cross-section per length of solidified stretched filament equal to one-half to twenty times the diameter of the filament.

* * * * *